US007140909B2

(12) United States Patent
Moritake

(10) Patent No.: US 7,140,909 B2
(45) Date of Patent: Nov. 28, 2006

(54) CONNECTOR CAPABLE OF EASILY INCREASING A HOLDING FORCE FOR HOLDING A CONNECTION OBJECT

(75) Inventor: Toshiyuki Moritake, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/281,669

(22) Filed: Nov. 17, 2005

(65) Prior Publication Data

US 2006/0110973 A1 May 25, 2006

(30) Foreign Application Priority Data

Nov. 19, 2004 (JP) ..... 2004-336400

(51) Int. Cl.
*H01R 12/24* (2006.01)

(52) U.S. Cl. ..... 439/492; 439/260; 439/329; 439/459

(58) Field of Classification Search ..... 439/492, 439/260, 329, 459
See application file for complete search history.

(56) References Cited

U.S. PATENT DOCUMENTS 6,322,388 B1 * 11/2001 Akio et al. ..... 439/459

* cited by examiner

*Primary Examiner*—Truc Nguyen
(74) *Attorney, Agent, or Firm*—Collard & Roe, P.C.

(57) ABSTRACT

In a connector to be connected to a connection object, a housing holds a contact having a conductivity. An operating member is coupled to the housing to bring a part of the connection object into press contact with the contact. The connector is provided with a locking member which is for clamping the other part of the connection object in cooperation with the operating member. It is preferable that the locking member is engaged with the operating member and the housing to lock the operating member with respect to the housing.

8 Claims, 7 Drawing Sheets

CONNECTOR CAPABLE OF EASILY INCREASING A HOLDING FORCE FOR HOLDING A CONNECTION OBJECT

This application claims priority to prior Japanese patent application JP 2004-336400, the disclosure of which is incorporated herein by reference.

BACKGROUND OF THE INVENTION

This invention relates to a connector for use in connecting a connection object such as a flexible printed circuit board (FPC) or a flexible flat cable (FFC).

Referring to FIG. 1, an existing connector of the type will be described. The connector 110 illustrated in the figure comprises a housing 20 to be mounted to a board (not shown) of an electronic apparatus, and a slider 30 to be inserted into the housing 20 to fix a connection object 50, such as a FPC or a FFC (hereinafter will collectively be referred to as a flexible member) when the connection object 50 is inserted into a coupling portion 23 of the connector 110. A contact 21 is press-fitted into the housing 20. The contact 21 has a supporting portion 21*c* press-fitted into and supported by the housing 20, first and second branched parts 21*a* and 21*b* as upper and lower parts extending from the supporting portion 21*c* into the coupling portion 23, and a terminal portion 21*d* extending rearward from the supporting portion 21*c* to be connected to the board.

After the connection object 50 is inserted into the coupling portion 23 of the housing 20, the slider 30 is inserted into the housing 20. At this time, the slider 30 is urged or biased downward by a spring force of the first part 21*a* to bring the connection object 50 into press contact with the second part 21*b*. Thus, the connection object 50 is electrically connected via the contact 21 to the board on which the connector 110 is mounted.

However, a holding force for holding the connection object 50 depends or relies solely on a clamping action by the slider 30 and the first part 21*a* and is therefore small. Accordingly, if the connection object 50 is applied with a load, the connection object 50 is easily released from the connector 110.

SUMMARY OF THE INVENTION

It is therefore an object of this invention to provide a connector capable of easily increasing a holding force for holding a connection object.

It is another object of this invention to provide a connector which is reduced in possibility of releasing a connection object even if the connection object is subjected to an undesired force such as a pulling force.

Other objects of the present invention will become clear as the description proceeds.

According to an aspect of the present invention, there is provided a connector to be connected to a connection object, the connector comprising a contact having a conductivity, a housing holding the contact, an operating member coupled to the housing to bring a part of the connection object into press contact with the contact, and a locking member for clamping the other part of the connection object in cooperation with the operating member.

DESCRIPTION OF THE PREFERRED EMBODIMENTS

Figure 1:
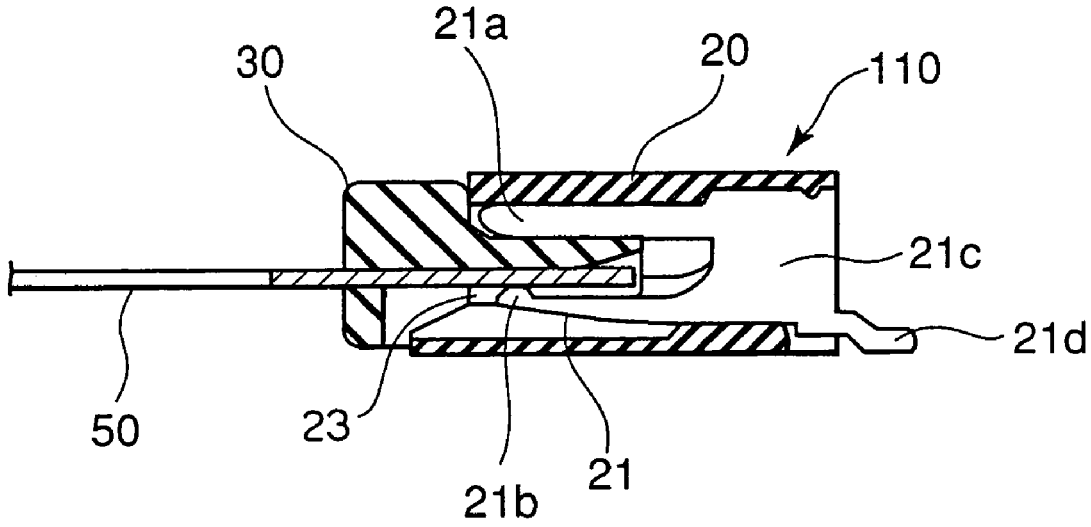
FIG. 1 RELATED ART
FIG. 1 is a sectional view of an existing connector.

Referring to FIGS. 2A to 5B, description will be made of a connector according to a first embodiment of this invention.

The connector is depicted at 101 in the figure and is used in relaying an electronic part and another electronic part or a circuit board included in an electronic apparatus. Therefore, the connector 101 will be called hereunder a relay connector 101.

The relay connector 101 comprises a plurality of contacts 21, a housing 20 holding the contacts 21, a slider 30 as an operating member inserted into the housing 20 to press a connection object 50 comprising a flexible member towards the contacts 21 held in the housing 20, and a locking member 10 for fixing the slider 30 to the housing 20.

The housing 20 has a rectangular cylindrical shape elongated in a first direction X and having a rectangular section. The housing 20 has one end provided with a first coupling portion 23 having an opening and the other end provided with a second coupling portion 22 connected to another relay connector. The first coupling portion 23 is provided with a plurality of contact receiving grooves 24 for receiving the contacts 21. The contact receiving grooves 24 are formed on one side of the first coupling portion 23 in a second direction Y perpendicular to the first direction X and arranged in parallel to one another in a third direction Z perpendicular to the first and the second directions X and Y.

On opposite sides of the housing 20 in the third direction Z, a pair of locking parts 12 is arranged. Each of the locking parts 12 has a rectangular shape with an engaging hole 12*a* formed at the center and has an elasticity. The locking part 12 has a lower portion as a supporting portion and an upper portion as a free end. At a base of the locking part 12, a first engaging surface 4 and a second engaging surface 15 are formed. A combination of the locking part 12 and the first and the second engaging surfaces 14 and 15 forms a locking portion 11.

The contacts 21 are enclosed in the housing 20 and arranged in parallel to one another in the third direction Z. As shown in FIG. 2A, the relay connector 101 has first and second connecting portions 26 and 27 adjacent to each other in the first direction X. Each of the contacts 21 has first and second contacting pieces 21*a* and 21*b* which are placed at the first and the second connecting portions 26 and 27, respectively. Only the second contacting piece 21*b* has an elasticity and is movable with respect to the housing 20 while the first contacting piece 21*a* is tightly fixed to the housing 20.

Figure 2B:
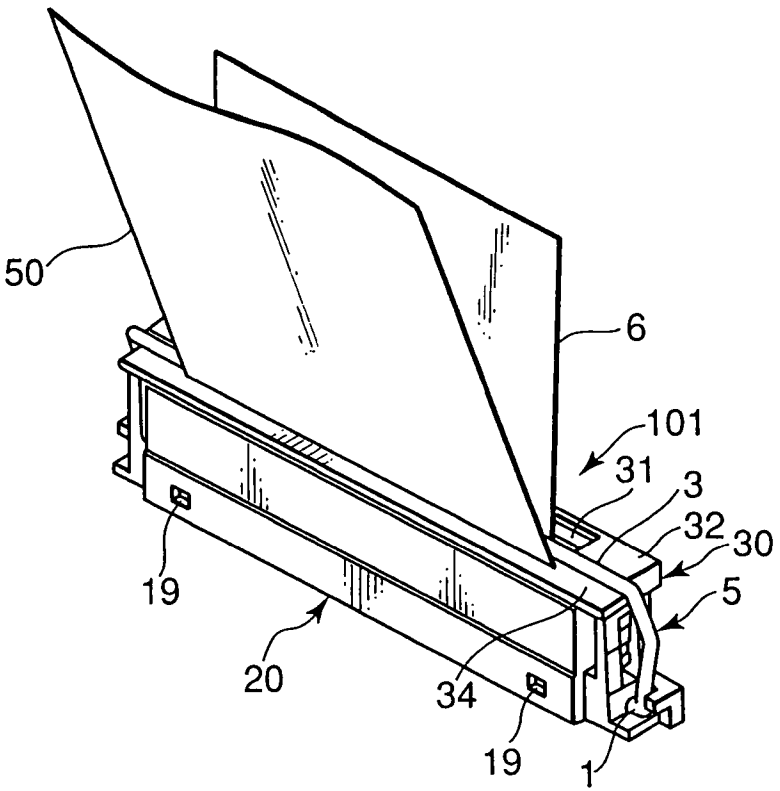
FIG. 2B is a perspective view of the connector illustrated in FIG. 2A.
Figure 2A:
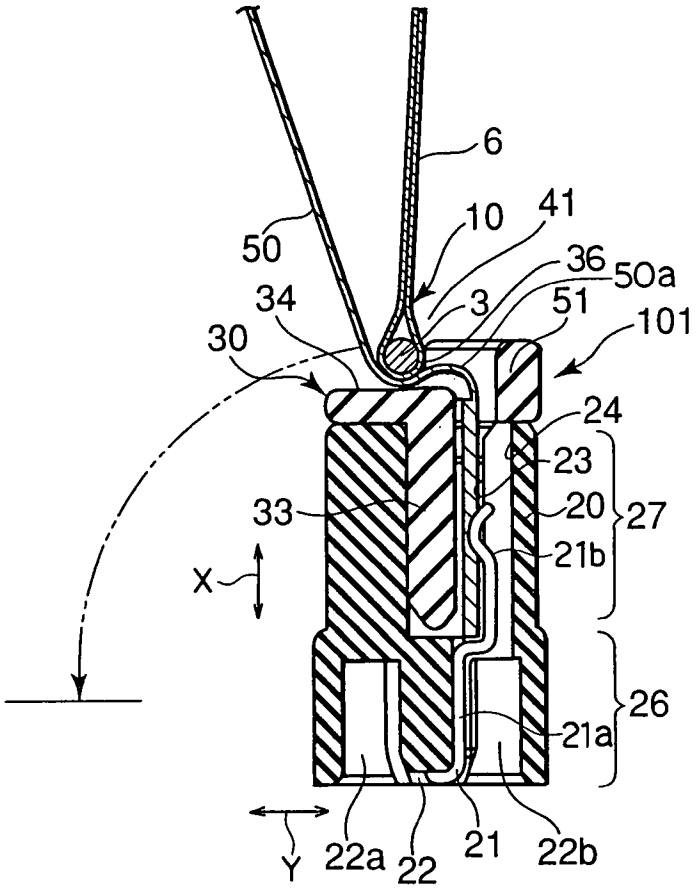
FIG. 2A is a sectional view of a connector according to a first embodiment of this invention when a connection object is locked.
Figure 3:
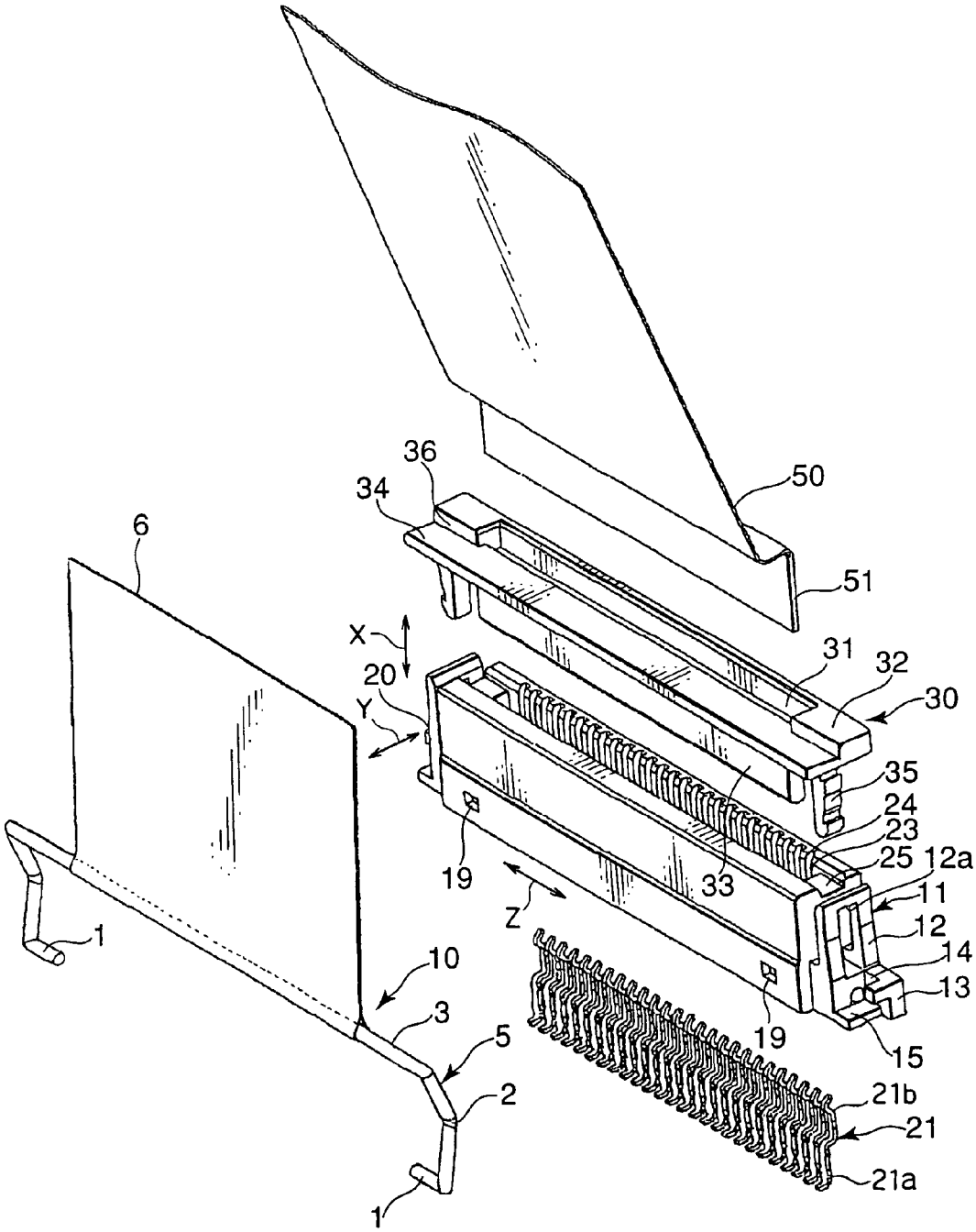
FIG. 3 is an exploded perspective view of the connector illustrated in FIGS. 2A and 2B.
Figure 4B:
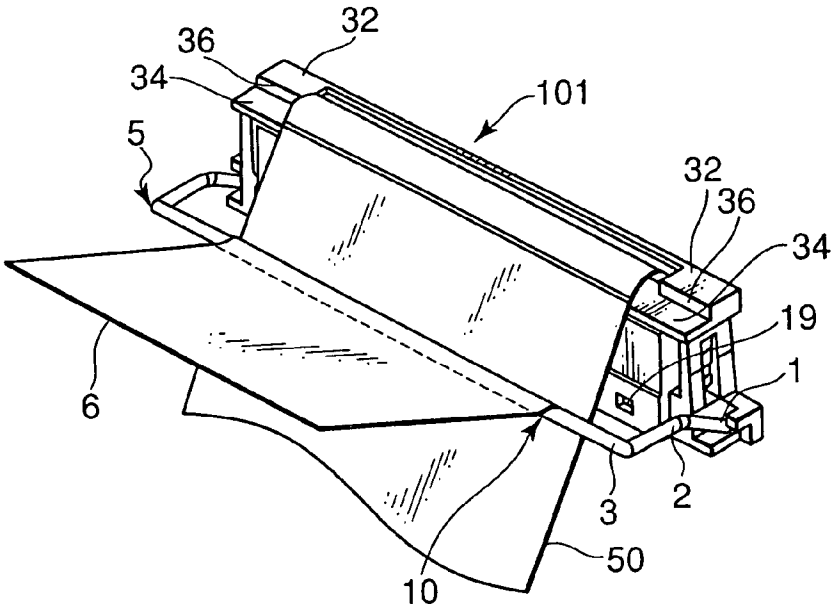
FIG. 4B is a perspective view of the connector illustrated in FIG. 4A.

The slider 30 is movable with respect to the housing 20 and locked in two states shown in FIGS. 2B and 4B. The slider 30 has an upper surface portion 32 having an inlet 31 for insertion of the connection object 50, a holding part 33 extending downward from the upper surface portion 32, and a pair of engaging portions 35 formed on opposite sides of the slider 30. The connection object 50 has a thickened end portion 51 and has a shape such that a conductor to be connected to the contacts 21 is exposed.

The locking member 10 has a lock bar 5 as a locking portion and an operating tape 6 as an operating portion. The lock bar 5 has a rod 3, a pair of arm portions 2 bent from opposite ends of the rod 3 and extending in a same direction perpendicular to the rod 3, a pair of rotation shafts 1 formed at ends of the arm portions 2 and protruding inward to face each other.

The operating tape 6 is wound around the lock bar 5 of the locking member 10 to be fixed. The operating tape 6 facilitates an operation of the locking member 10 in a rotating direction. Further, when the connection object 50 connected to the second connecting portion 27 is released, the operation tape 6 is pulled in a releasing direction to facilitate releasing of the connection object 50 from the second connecting portion 27.

Next referring to FIGS. 6 and 7 in addition, a locking operation and an unlocking operation of the relay connector 101 will be described.

Referring to FIGS. 2A and 2B, in a locked state of the relay connector 101, the lock bar 5 of the locking member 10 is kept in contact with another upper surface 34 of the slider 30 to lock or inhibit the movement of the slider 30 by the rod 3 of the lock bar 5 as the locking portion. On lateral sides of the slider 30, the engaging portions 35 are engaged with the engaging holes 12*a* of the locking parts 12. A part of the connection object 50 is inserted into the coupling portion 23 and press-contacted with the contacts 21 by the holding part 33 of the slider 30. Further, the connection object 50 is bent and extracted from the inlet 31 on the upper surface portion 34 of the slider 30. Thus, the locking member 10 and the contact 21 in cooperation with the slider 30 cause a bent portion 50*a* to be formed in the connection object 50. The other part of the connection object 50, i.e., a part extracted on the upper surface 34 is pressed by the lock bar 5 of the locking member 10 and clamped between the upper surface 34 of the slider 30 and the lock bar 5. Therefore, in this state, even if the connection object 50 is pulled, the connection object 50 is prevented from being released from the relay connector 101. A position of the locking member 10 in this state is called a first position (locking position).

Figure 4A:
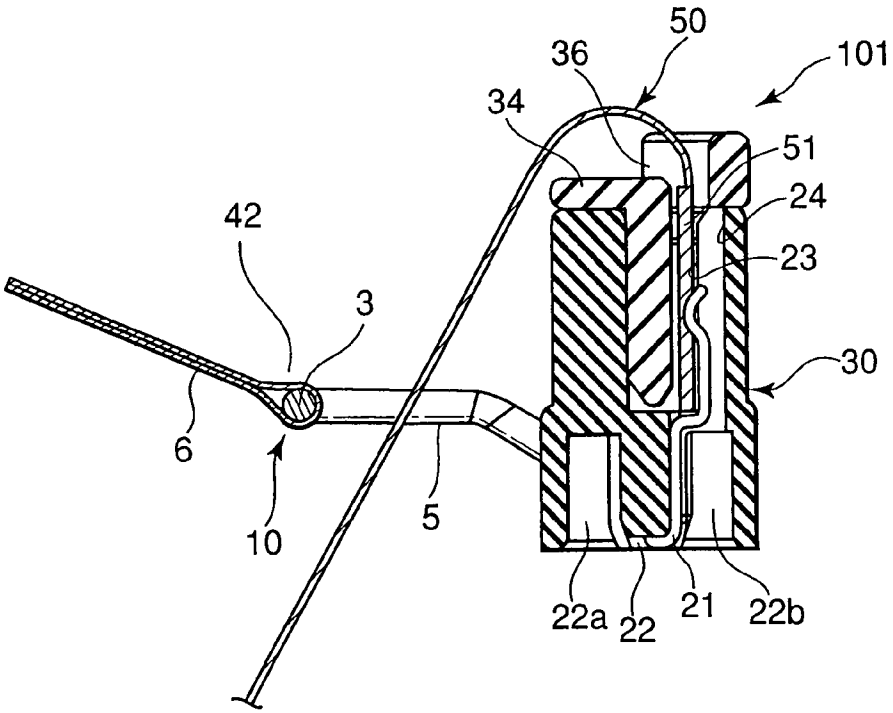
FIG. 4A is a sectional view of the connector illustrated in FIGS. 2A and 2B when a slider is inserted and a locking member is not fixed.
Figure 5B:
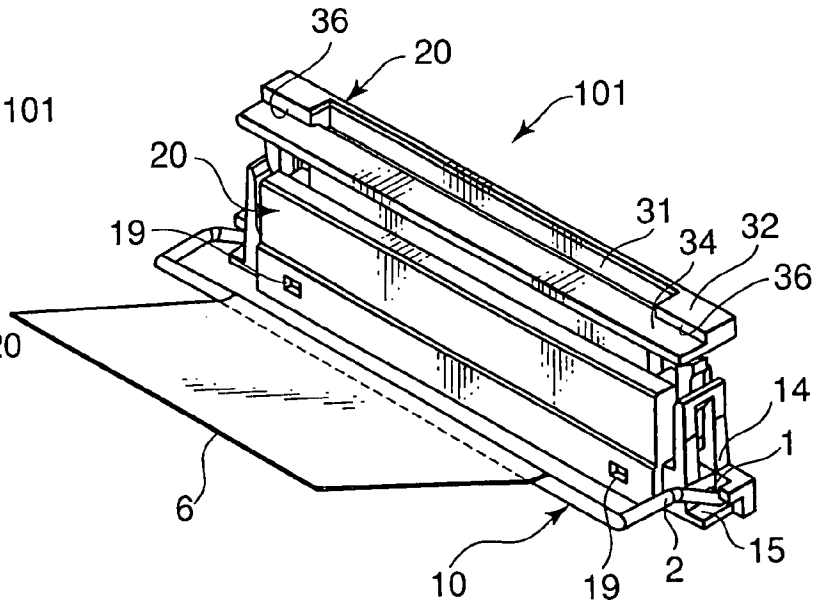
FIG. 5B is a perspective view of the connector illustrated in FIG. 5A when the slider is not inserted.
Figure 5A:
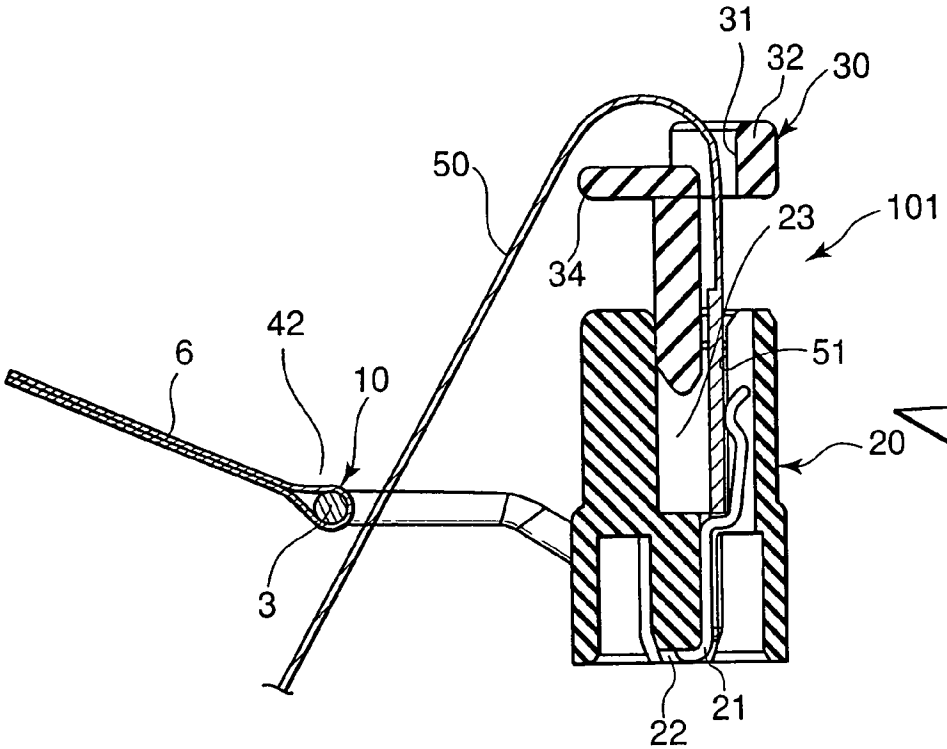
FIG. 5A is a sectional view of the connector illustrated in FIGS. 2A and 2B when the slider is not inserted and the connection object is provisionally inserted.
Figure 6:
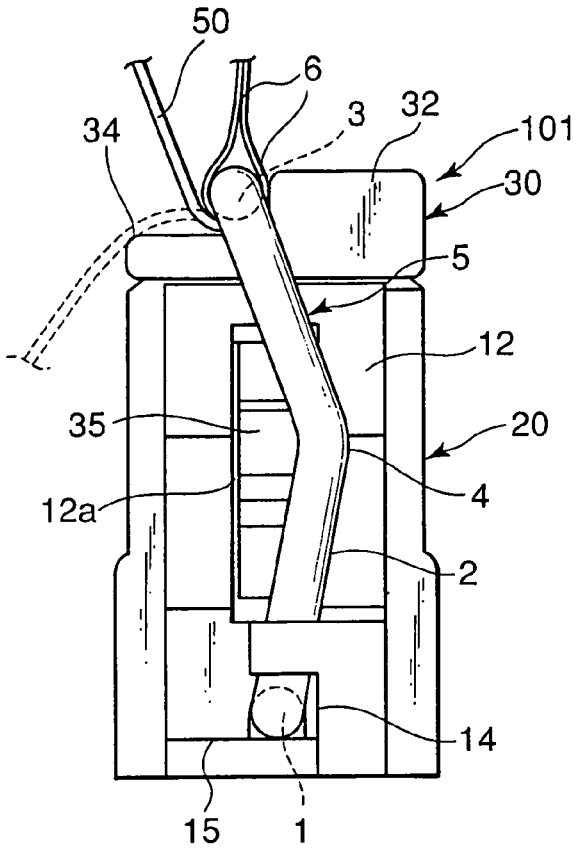
FIG. 6 is a partially-omitted side view for describing the locking member of the connector illustrated in FIG. 2A.
Figure 7:
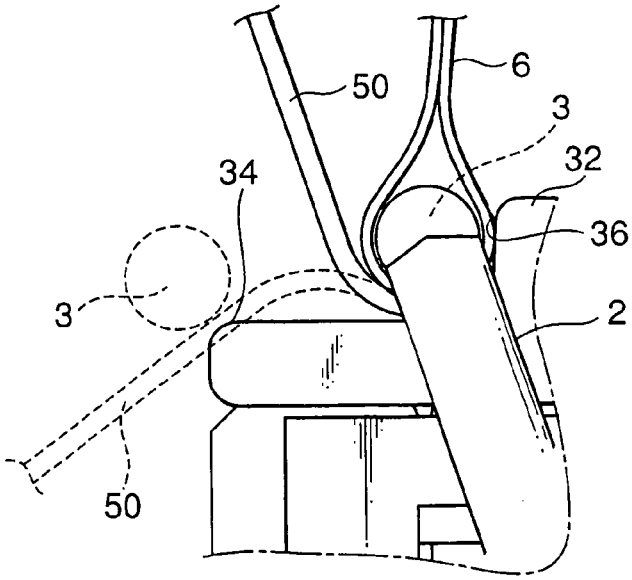
FIG. 7 is an enlarged view of a part of the connector illustrated in FIG. 6.

Next, in the state illustrated in FIG. 6, the operation tape 6 is pulled downward as shown in broken lines in FIG. 7 and in FIGS. 4A and 4B. Then, the locking member 10 is rotated around the rotation shafts 1. As shown in FIG. 7, the lock bar 5 as the locking portion moves over a corner portion of the slider 30 to reach a second position (unlocking position) 42 as shown in FIG. 4A. At this time, an operator is given a click feeling known in the art. On the other hand, around the rotation shafts 1 of the locking member 10, the arm portions 2 of the locking member 10 which have been kept in contact with the first engaging surfaces 14 as shown in FIG. 6 are brought into contact with the second engaging surfaces 15 as shown in FIGS. 4A and 4B. At this time, the locking parts 12 of the housing 20 are released from the state where the locking parts 12 are inhibited by the arms 2 from outward movement and are movable outward. Therefore, as shown in FIGS. 5A and 5B, when the slider 30 is pulled upward, engagement on the lateral sides is released so that the slider 30 can easily be pulled out together with the connection object 50.

On the other hand, upon connection, the connection object 50 is inserted through a space between the housing 20 and the locking member 10 into the second connecting portion 27, as shown in FIG. 5A. Next, as shown in FIG. 4A, the slider 30 is inserted so that the end portion 51 of the connection object 50 and the contacts 21 are brought into contact with each other. Then, the locking member 10 is rotated from the second position 42 to the first position 41. The locking member 10 is positioned at the first position 41 with a step portion 36 as a stopper. This position namely the first position 41 is offset from an extension line of an inner portion of the connection object 50 which is enclosed in the relay connector 101. Thus, the connection object 50 is bent in an S shape as shown in FIG. 2A so that the connection object 50 such as a cable can be firmly fixed to the relay connector 101.

In order to move the locking member 10, the operation tape 6 is held and pulled. Alternatively, the connection object 50 is held and pulled so that the locking member 10 can be moved to the first position 41.

Figure 8:
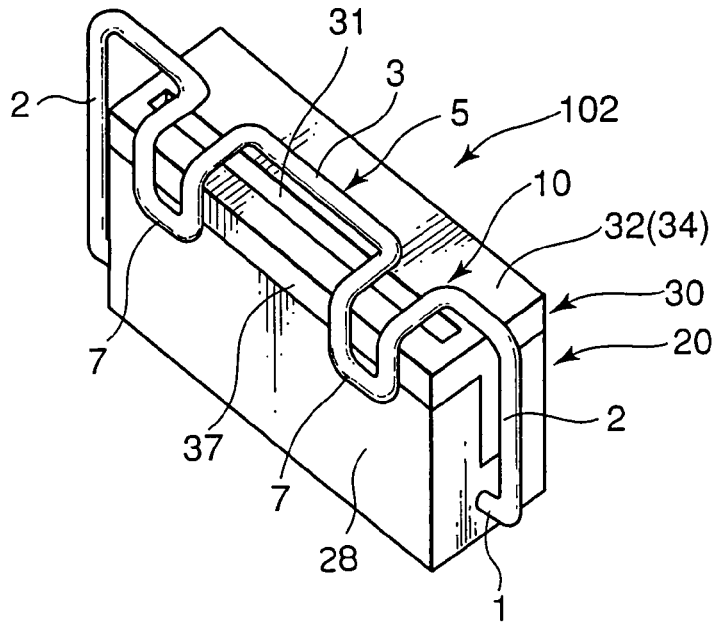
FIG. 8 is a perspective view mainly showing a locking member of a connector according to a second embodiment of this invention.

Next referring to FIG. 8, description will be made of a connector according to a second embodiment of this invention. Similar parts are designated by like reference numerals.

The connector depicted at 102 in the figure is also called a relay connector. In the relay connector 102, the rod 3 of the locking member 10 is provided with engaging portions 7 formed at two positions in a longitudinal direction near opposite sides thereof. Each of the engaging portions 7 has a U shape and bent in an L shape. With this structure, the rod 3 and base portions of the engaging portions 7 of the locking member 10 are brought into contact with the upper surface 32 and a side surface 37 of the slider 30. End portions of the engaging portions 7 are brought into contact with a side surface 28 of the housing 20. Accordingly, the slider 30 is locked. The connection object 50 is extracted from the inlet 31, passes along the upper surface 32 of the slider 30, is clamped by the engaging portions 7, and extends along the side surface 37 and the side surface 28.

On the other hand, an unlocking operation is carried out by rotating the rod 3 of the lock bar 5 downward, like in the relay connector 101 described in conjunction with FIGS. 2A to 5B. When the rod 3 moves over the corner portion of the slider 30, the operator is given a click feeling.

Figure 9:
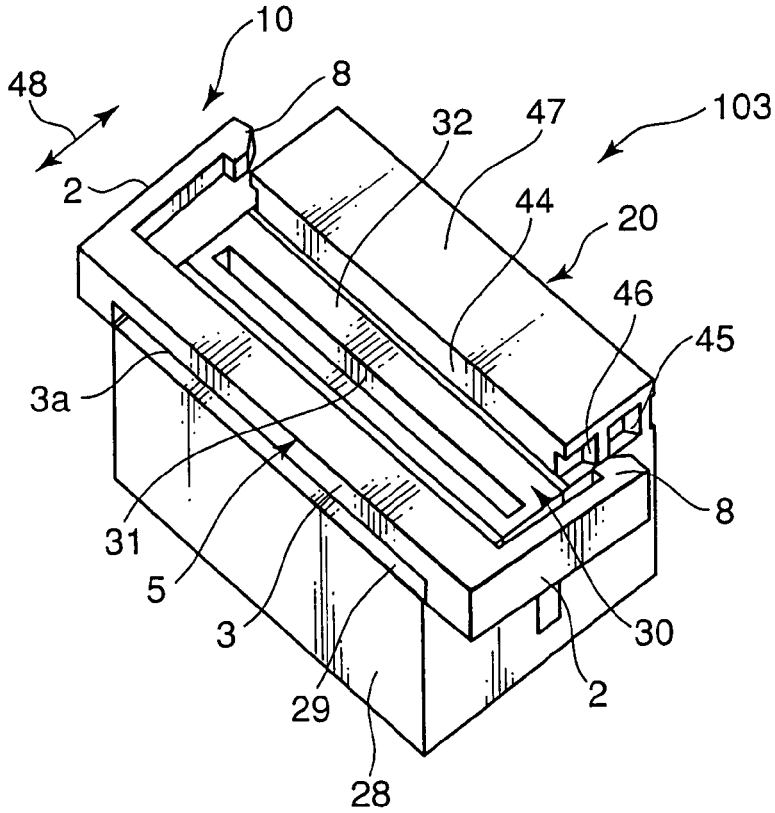
FIG. 9 is an enlarged view of a part of a connector according to a third embodiment of this invention.

Referring to FIG. 9, description will be made of a connector according to a third embodiment of this invention. Similar parts are designated by like reference numerals.

The connector depicted at 103 in the figure is also called a relay connector. In the relay connector 103, the housing 20 is provided with a step portion 47. On each of opposite sides of the step portion 47, a pair of engaging holes 45 and 46 are arranged adjacent to each other. On the other hand, the slider 30 is received adjacent to the step portion 47 of the housing 20. The locking member 10 is different from those of the relay connectors 101 and 102 in that the locking member 10 has engaging portions 8 having ends protruding inward. When the engaging portions 8 of the locking member 10 are engaged with the holes 45, the slider 30 can not be pulled out because of presence of the lock bar 5. When the locking member 10 is slid frontward in a horizontal direction (corresponding to the second direction Y) depicted by an arrow 48, the engaging portions 8 are engaged with the holes 46. At this time, the lock bar 5 is located at a position where the lock bar 5 does not inhibit the movement of the slider 30. Then, the slider 30 can be pulled out. The connection object 50 is pulled out through a gap 3*a* formed on a lower surface of the rod 3. When the engaging portions 8 of the locking member 10 move from one of the holes 45 and 46 to the other, a click feeling is given. Further, at a position where the engaging portions 8 are inserted in the engaging holes 46, the locking member 10 may be pulled out.

In each of the above-mentioned relay connectors 101, 102, and 103, the connection object 50 is bent by the locking member 10 and the slider 30 so as to increase a holding force for holding the connection object 50 with respect to each of the relay connectors 101, 102, and 103.

While the present invention has thus far been described in connection with the preferred embodiments thereof, it will readily be possible for those skilled in the art to put this invention into practice in various other manners. For example, the locking member may movably be held by the slider so as to be engaged with the housing in response to necessity while it is held by the housing in each of the embodiments.

What is claimed is:

1. A connector to be connected to a connection object, the connector comprising:

a contact having a conductivity;

a housing holding the contact;

an operating member coupled to the housing to bring a part of the connection object into press contact with the contact; and a locking member for clamping the other part of the connection object in cooperation with the operating member, the operating member being movable in a first direction between a connecting position at which the connection object is brought into press contact with the contact and an unconnecting position at which the connection object is not brought into press contact with the contact, and the locking member being engaged with the housing to be movable between a locking position at which the locking member engages with the operating member through the connection object in the first direction to lock the operating member at the connecting position and an unlocking position at which the locking member does not engage with the operating member in the first direction to thereby enable movement of the operating member from the connecting position towards the unconnecting position.

2. The connector according to claim 1, wherein the contact is faced to the operating member at the connecting position in a second direction perpendicular to the first direction, the part of the connection object being interposed between the contact and the operating member.

3. The connector according to claim 1, wherein the locking member is movably held by the housing.

4. The connector according, to claim 1, wherein:

the contact and the locking member cause a bent portion to be formed in the connection object in cooperation with the operating member;

the part and the other part being positioned on opposite sides of the bent portion.

5. The connector according to claim 3, wherein the locking member has an engaging portion to be engaged with the operating member in the first direction via the other part of the connection object when the operating member is located at the connecting position and the locking member is located at the locking position.

6. The connector according to claim 5, wherein the locking member comprises:

a lock bar rotatably engaged with the housing; and an operating portion connected to the lock bar.

7. The connector according to claim 6, wherein the lock bar and the operating portion cooperatively form the engaging portion.

8. The connector according to claim 5, wherein the locking member is slidable with respect to the housing between the locking position and the unlocking position in a second direction perpendicular to the first direction.

* * * * *